United States Patent [19]

Maire

[11] Patent Number: 4,666,311

[45] Date of Patent: May 19, 1987

[54] ELECTRONIC TIMEPIECE WITH ANALOGUE DISPLAY

[75] Inventor: Robert Maire, Rolle, Switzerland

[73] Assignee: Frederic Piguet S.A., Canton of Vaud, Switzerland

[21] Appl. No.: 715,524

[22] Filed: Mar. 25, 1985

[30] Foreign Application Priority Data

Apr. 3, 1984 [CH] Switzerland ..... 1684/84

[51] Int. Cl.[4] ..... G04B 19/04

[52] U.S. Cl. ..... 368/80; 368/87; 368/155

[58] Field of Search ..... 368/28, 87, 76, 80, 368/155–157, 160, 110–113, 200–202

[56] References Cited

U.S. PATENT DOCUMENTS

| | | | |
|---|---|---|---|
| 3,800,233 | 3/1974 | Sauthier | 377/50 |
| 3,884,035 | 5/1975 | Jeannet et al. | 368/110 |
| 3,945,194 | 3/1976 | Gollinger | 368/201 |
| 4,081,951 | 4/1978 | Hersberger | 368/87 |
| 4,148,184 | 4/1979 | Akahane et al. | 368/159 |
| 4,211,066 | 7/1980 | Kusumoto et al. | 368/113 |
| 4,266,288 | 5/1981 | Berney | 368/185 |
| 4,270,197 | 5/1981 | Minowa | 368/102 |
| 4,364,669 | 12/1982 | Thoenig et al. | 368/111 |
| 4,376,991 | 3/1983 | Piaget | 368/28 |
| 4,440,502 | 4/1984 | Kanno | 368/157 |
| 4,523,857 | 6/1985 | Ushikoshi | 368/157 |
| 4,537,514 | 8/1985 | Moriya | 368/107 |
| 4,540,297 | 9/1985 | Dubois | 368/28 |

*Primary Examiner*—Vit W. Miska

*Attorney, Agent, or Firm*—Silverman, Cass, Singer & Winburn, Ltd.

[57] ABSTRACT

A chronograph watch comprises a first motor controlled by a quartz resonator coupled to a first simple integrated circuit. This motor drives, through gearing, the time indicating members of the watch. A second motor controlled by a second quartz resonator coupled to a second simple integrated circuit, identical to said first integrated circuit, can be operated at a higher frequency when a switch, which is operable manually by means of a pushbutton and interposed between electrical ground and a terminal of the second integrated circuit, is open. The second motor drives, through further gearing, a chronograph hand coupled to a minute counter and to an hour counter. Thus the chronograph indicates fractions of seconds without the timepiece requiring expensive circuits or having an excessive electrical power consumption.

14 Claims, 5 Drawing Figures

ELECTRONIC TIMEPIECE WITH ANALOGUE DISPLAY

BACKGROUND OF THE INVENTION (a) Field of the Invention

This invention relates to an electronic timepiece provided with an analogue display, comprising at least one quartz resonator constituting the time base and at least two motors a first one of which serves to drive continuously the time display elements of the timepiece, and the second one of which serves to drive, on request, elements which display supplementary data, said first motor being coupled to a simple integrated circuit.

(b) Description of the Prior Art

The known quartz timepieces having an analogue display comprise at least one quartz resonator the frequency of which is electronically divided to provide the input frequency, generally situated between 0.5 and 0.05 Hz, of at least one stepping motor. The integrated circuit interposed between the quartz resonator and the motor is a well known circuit which can be produced in large quantities, and consequently at a very low cost.

SUMMARY OF THE INVENTION

Thus in the known watches, the principle of which is diagrammatically illustrated in FIG. 1, the time indicators are constituted by hour hands, minute hands and second hands, Ah, Am and As respectively, driven by a motor M. The latter is controlled, through the intermediary of a simple integrated circuit IC, by a quartz resonator Q to which is added a trimmer Tr. The integrated circuit IC comprises input and output terminals A - B - C - D - E - F - G - H, among which, for instance, A is a supply input terminal, C and D are terminals for control of the motor M, and G and H are terminals connected to the quartz resonator Q and to the trimmer Tr. The terminal B can be a control input for stopping the motor M, the terminal E a control input or terminal of acceleration for increasing the frequency controlling the motor M, and the terminal F a terminal connected to electrical ground. By interconnecting terminals B and F, for instance, one can stop the motor, and by interconnecting terminals E and F achieve acceleration of the motor for testing the divider chain and the motor, the frequency delivered in this case being, generally, of 16 or 32 Hz.

If it is desired to add to such a watch supplementary functions such as a chronograph, calendar, perpetual calendar, horar time-belts, phases of the moon, alarm, repetition alarm, the integrated circuit controlling the watch rapidly becomes very complicated and more expensive, since it is produced in a very small quantity as compared with the simple conventional circuits. Several solutions have been proposed or are possible. In the case of the chronograph watch, for instance, according to one construction the watch comprises a motor, a normal integrated circuit and a mechanical chronograph device connected to the quartz watch. Such a watch, which uses a normal and consequently cheap integrated circuit, exhibits the important drawback of being able to count times only to one second more or less, the circuit delivering to the motor only one frequency suitable for seconds pulses. Now, in chronometred races, there are often fractions of seconds (1/5, 1/10 or 1/100) separating the competitors, so that such a chronograph is unsufficiently accurate. For removing this drawback, it is possible to produce a chronograph displaying fractions of seconds, of 1/5 for instance, while driving the motor to a higher frequency of 2.5 Hz, for instance.

This solution is interesting so far as the precision of the indications furnished by the chronograph is concerned, the integrated circuit remaining simple, but it then exhibits the important drawback of requiring, permanently, a power input about 2.5 times higher. This reduces intolerably the effective running time of the watch or else necessitates a battery which is substantially larger, which considerably detracts from the aesthetic design of the timepiece.

A solution which overcomes the above mentioned drawbacks consists in using a special circuit providing an output for the motor of the watch itself, driving the time display, and a second output for a second motor driving the chronograph displaying fractions of second, 1/10 for instance. This solution is very expensive since it necessitates the production of a special integrated circuit, which is complex, larger and will be manufactured only in small quantities as compared with the preceding circuit.

The present invention has for its object to furnish a watch which does not possess the above mentioned drawbacks, while offering the possibility of performing other functions than a display of the time.

This object is achieved by the fact that the electronic timepiece according to the present invention is provided with a second motor coupled to a simple integrated circuit comprising a terminal of acceleration connected to an electrical ground terminal and which delivers to the input terminals of the second motor a frequency which is higher than that which is received by the first motor.

The various features of the invention will be apparent from the following description, drawings and claims, the scope of the invention not being limited to the drawings themselves as the drawings are only for the purpose of illustrating ways in which the principles of the invention can be applied. Other embodiments of the invention utilising the same or equivalent principles may be used and structural changes may be made as desired by those skilled in the art without departing from the present invention and the purview of the appended claims.

BRIEF DESCRIPTION OF THE DRAWINGS

The drawings show by way of example, except FIG. 1 which illustrates the prior art, several embodiments of the invention.

DESCRIPTION OF THE PREFERRED EMBODIMENTS

Figure 1:
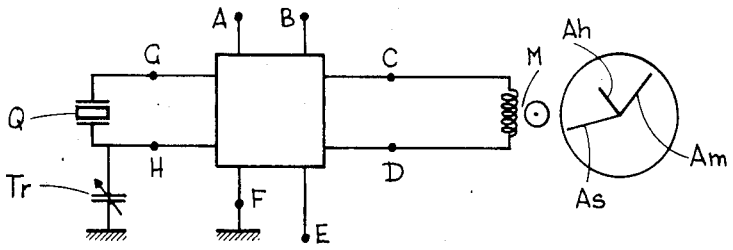

In all the different drawing figures the same elements have been designated by the same reference numerals as used in FIG. 1.

Figure 2:
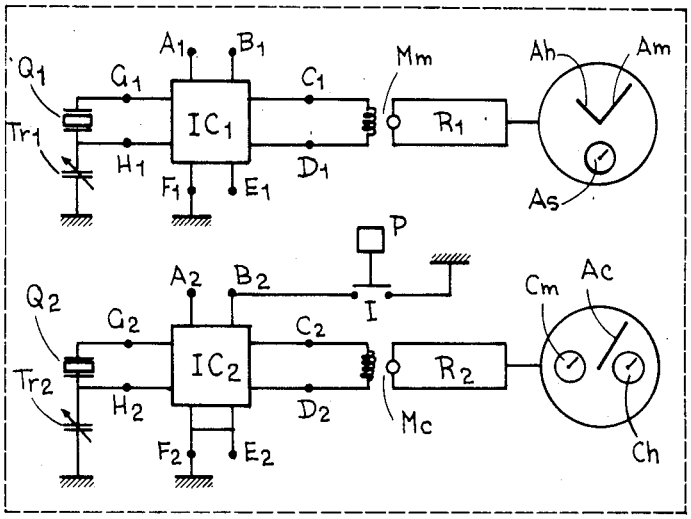
FIGS. 2 to 4 illustrate circuits, which are indicated very diagrammatically, of four embodiments of electronic chronograph quartz watches having an analogue display.

The watch of FIG. 2 is a chronograph provided with a precise display of fractions of seconds comprising conventional integrated circuits, which are cheap. This watch comprises two quartz resonators $Q_1$ and $Q_2$ associated with their adjusting trimmers $Tr_1$ and $Tr_2$. The quartz resonator $Q_1$ is coupled to an integrated circuit $IC_1$ which controls a motor Mm driving conventional gearing $R_1$ which in turn drives the hands Ah, Am and As displaying hours, minutes and seconds, respectively; the watch can, may be, also comprise a calendar mechanism. The quartz resonator $Q_2$ is coupled to an integrated circuit $IC_2$, identical to the circuit $IC_1$, controlling a motor of a chronograph Mc which drives gearing $R_2$ which in turn drives the chronograph hands Ac which display fractions of seconds, coupled to a minute counter Cm and an hour counter Ch. The terminals $E_2$–$F_2$ of the circuit $IC_2$ are interconnected which has the effect that the motor Mc is controlled at an increased frequency, generally of 16 or 32 Hz. Hence, the movement of the second hand of the chronograph is a movement practically continuous or which, at least, appears as such. Another advantage lies in the fact that, since the motor Mc working at a higher speed, its output torque can be lower with an input energy which is unchanged.

For starting the motor Mc, it is necessary to open a switch I, operable manually by a pushbutton P, connected between the terminal $B_2$ of the circuit $IC_2$ and the electrical ground. For stopping the motor Mc, it is necessary to close the switch I by a second pressure on the pushbutton P. The "on" and "off" functions of the chronograph are thus realized.

Figure 3:
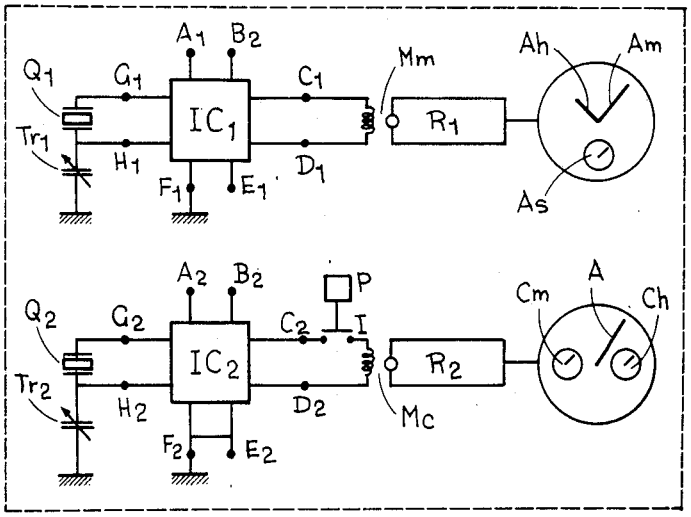

In the second embodiment, of FIG. 3, the pushbutton P and the switch I are arranged with the latter connected directly on to one of the input terminals of the chronograph motor Mc.

Figure 4:
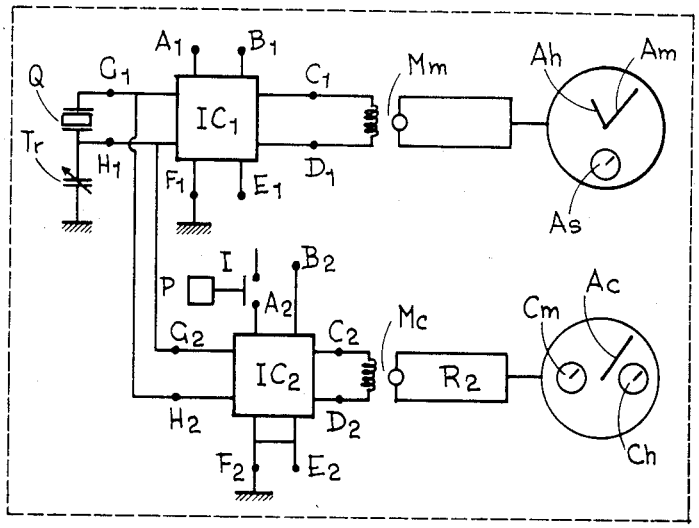

The present watch may comprise only one quartz resonator as a time base. This is the case, for instance, with the third embodiment shown in FIG. 4, in which the pushbutton P and the switch I are disposed at the feed input terminal $A_2$ of the circuit $IC_2$.

A chronograph watch is only one example of the possible applications of the invention. Any construction requiring an input of supplementary energy during a certain time can also be achieved according to the invention. Thus this is the case with the calendars and perpetual calendars, of devices permitting the changes of time belts or the indication of the phases of the moon, of alarms, of repetition alarms, etc.

Figure 5:
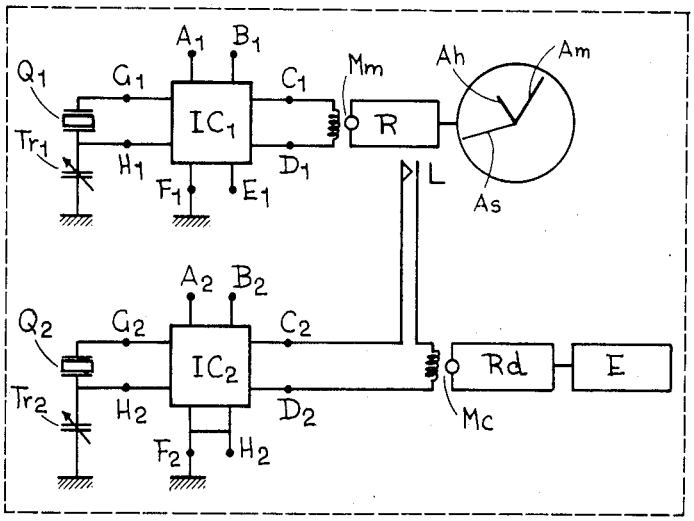
FIG. 5 is a similar representation of a calendar watch.

FIG. 5 illustrates a calendar watch the motor Mm of which drives conventional gearing R. On one of the wheels of this gearing there is secured a cam operative for closing of a contact L. This contact L starts the second motor Mc which drives gearing Rd ensuring the driving of a module E of supplementary functions, in this case a calendar. The stopping of the motor Mc can be controlled either by the gearing R or by the gearing Rd, through means which are not shown, being known per se, and constituted by contacts which these gearings will open.

In the control of the change of time belts, it is an external pushbutton of the watch, operable manaually, which controls the starting of the second motor, as for the chronograph, the stopping of this second motor being controlled by a contact operated by its own gearing after a displacement by one hour of the hour hand.

I claim:

1. An electronic timepiece having an analogue display comprising at least one quartz resonator constituting the time base and at least two motors, a first one of said motors being operative to drive continuously the conventional time display elements of the timepiece, such as the hour, minute and second hands of the timepiece, and the second one of said motors being operative to drive, on request, elements which display supplementary data different from said conventional display elements, said first motor being coupled to a first simple standard integrated circuit and said second motor being coupled to a second simple standard integrated circuit substantially identical to said first circuit including a terminal of acceleration permanently connected to an electrical ground terminal and which delivers to the input terminals of said second motor a frequency which is higher than that received by said first motor.

2. An electronic timepiece as claimed in claim 1, in which said one quartz resonator is one of two quartz resonators which are individually connected to said first and second integrated circuits controlling the first and the second motor respectively.

3. An electronic timepiece as claimed in claim 1, in which said one quartz resonator is coupled to said first and second integrated circuits controlling the first and the second motor, respectively.

4. An electronic timepiece as claimed in claim 1, in which means for controlling the starting and the stopping of said second motor comprises a switch connected between a terminal of said second integrated circuit for stopping the second motor and the ground terminal of the second integrated circuit.

5. An electronic timepiece as claimed in claim 1, in which means for controlling the starting and the stopping of said second motor comprises a switch connected to one of the inputs of the second motor.

6. An electronic timepiece as claimed in claim 1, in which means controlling the starting and the stopping of said second motor comprises a switch connected to the input feed terminal of said second integrated circuit controlling the second motor.

7. An electronic timepiece as claimed in claim 4, in which said switch controlling said second motor is arranged in such a way as to be manually operable.

8. An electronic timepiece as claimed in claim 5, in which said switch controlling said second motor is arranged in such a way as to be manually operable.

9. An electronic timepiece as claimed in claim 6, in which said switch controlling said second motor is arranged in such a way as to be manually operable.

10. An electronic timepiece as claimed in claim 5, in which said switch controlling said second motor is arranged in such a way as to be operated by said first motor.

11. A method of increasing the output frequency of a standard electronic timepiece integrated circuit, said method comprising:

providing the standard integrated circuit having a standard low frequency output with a terminal of acceleration and permanently coupling said terminal of acceleration to ground to increase said circuit output to a second frequency higher than said standard low frequency; and providing special indicators for the timepiece and coupling said second frequency to said special indicators for driving said indicators.

12. The method defined in claim 11 including providing said standard low frequency on the order of 1 hertz and increasing said circuit output to said second frequency on the order of 16 hertz or greater.

13. An apparatus for increasing the output frequency of a standard electronic timepiece integrated circuit, said apparatus comprising:

the standard integrated circuit having a standard low frequency output with a terminal of acceleration and means for permanently coupling said terminal of acceleration to ground to increase said circuit output to a second frequency higher than said standard low frequency; and the timepiece including special indicators and means for coupling said second frequency on request to said special indicators for driving said indicators.

14. The apparatus defined in claim 13 wherein said standard low frequency is on the order of 1 hertz and said increased circuit output second frequency is on the order of 16 hertz or greater.

* * * * *